United States Patent [19]

Foster et al.

[11] Patent Number: 4,799,556

[45] Date of Patent: Jan. 24, 1989

[54] DRILLING BOOM

[75] Inventors: Bruce A. Foster, Retford; Raymond Hedges, Worksop, both of United Kingdom

[73] Assignee: The Steel Engineering Co., Ltd., Roodepoort, South Africa

[21] Appl. No.: 32,636

[22] Filed: Apr. 1, 1987

[30] Foreign Application Priority Data

Apr. 2, 1986 [GB] United Kingdom ..... 8607997

[51] Int. Cl.[4] ..... E21C 5/00; E21C 9/00

[52] U.S. Cl. ..... 173/43; 248/654

[58] Field of Search ..... 173/39, 42–44; 248/654

[56] References Cited

U.S. PATENT DOCUMENTS

| | | | |
|---|---|---|---|
| 3,727,867 | 4/1973 | Toppila | 248/16 |
| 4,290,491 | 9/1981 | Mayer | 173/43 |

FOREIGN PATENT DOCUMENTS

| | | |
|---|---|---|
| 0004840 | 10/1979 | European Pat. Off. . |
| 0016717 | 10/1980 | European Pat. Off. . |
| 0149056 | 11/1984 | European Pat. Off. . |
| 0140873 | 5/1985 | European Pat. Off. . |
| 731528 | 6/1955 | United Kingdom . |
| 1264528 | 2/1972 | United Kingdom . |
| 1262666 | 2/1972 | United Kingdom . |
| 1283594 | 7/1972 | United Kingdom . |
| 1361716 | 7/1974 | United Kingdom . |
| 2156714A | 10/1985 | United Kingdom . |

*Primary Examiner*—Donald R. Schran
*Assistant Examiner*—James L. Wolfe
*Attorney, Agent, or Firm*—Kinzer, Plyer, Dorn, McEachran & Jambor

[57] ABSTRACT

A drilling boom has an articulated arm 12 which carries a drill feed beam 28 on its outer end. Apart from the articulation 36, 38 provided by the joint at the outer end of the arm, the feed beam can rotate about two mutually perpendicular axes at the end of the arm. One of these axes is defined by the so-called rollover unit 44 and the other axis 92 is at right angles to the length of a drill rod on the feed beam and allows at least 180 degrees of rotation so that parallel holes can be drilled in all parts of the roof, floor and side walls of a heading.

7 Claims, 3 Drawing Sheets

DRILLING BOOM

This invention relates to a drilling boom for use in mining and tunnelling operations.

Drilling booms conventionally are mounted on a mobile carrier such as a wheeled chassis and have an arm articulated to the carrier, a mounting at the remote end of the arm on which a feed beam is mounted and means for moving the arm about pivot axes fixed to the carrier. The feed beam supports a rock drill and guides the drill steel as it is driven into the rock face. Various pivots and pivot control mechanisms are known to enable the arm and the feed beam to be positioned by an operator at any desired position on the face without having to move the carrier, and in particular it is conventional to provide parallel movement linkages so that as the arm is moved, the feed beam always remains in the same orientation.

The feed beam can be positioned for drilling straight ahead (in line with the boom) into the face, or for drilling at right angles to the boom into the roof, floor and sides of a heading.

It is known to mount either a single boom or multiple booms on a carrier.

According to the invention, there is provided a drilling boom comprising an arm articulated at one end on a carrier, a mounting for a drill feed beam articulated at the opposite end of the arm, and a roll-over unit between the mounting and said opposite end of the arm which allows the mounting to roll about an axis which, in face drilling, will be parallel to the length of a drill on the mounted feed beam, wherein the mounting is also rotatable through substantially 180 degrees about an axis perpendicular to the length of a drill on a mounted feed beam so that a drill on the feed beam can operate in two mutually opposite directions.

The rotatability of the feed beam mounting means that a single boom can be used to drill parallel holes in the roof, floor and sides of a heading, even in the diagonally opposite pair of corners of a rectangular cross section heading which have not been accessible to prior art single boom units.

The articulation between the arm, the carrier and the mounting is preferably arranged so that the mounting executes parallel motion when the arm moves. The parallel motion linkage can however be overridden if desired.

The rotation of the mounting through substantially 180 degrees of an axis perpendicular to the length of the drill can be accomplished through the use of a rifle bar rotation unit. Alternatively, a gear box could be used to enable the rotation to take place. Although 180 degrees of rotation is theoretically required (and can be achieved with the use of a rifle bar rotation unit), satisfactory performance could be achieved with a rotation capability of about 170 degrees, and the term "substantially 180 degrees" is to be construed accordingly.

This rotation could be through more than 180 degrees, although a full 360 degree rotation is unlikely to be necessary.

The rotation could be accomplished by a unit which includes a rotation mechanism and a holding mechanism, the holding mechanism being effective to hold the mounting against rotation once a desired position has been reached, and thus to unload the rotation mechanism whilst drilling takes place.

The roll-over unit preferably also has a rifle bar mechanism.

The boom is preferably hydraulically operated.

The arm may be telescopic, or of fixed length.

The invention will now be further described, by way of example, with reference to the accompanying drawings, in which.

Figure 1:
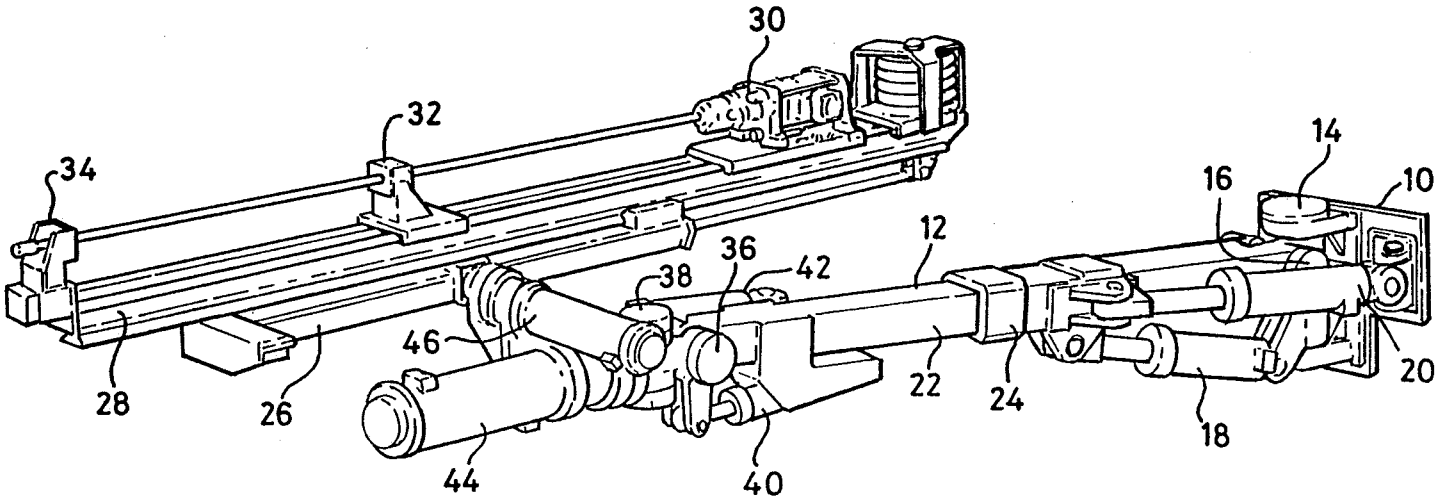
FIG. 1 is a schematic perspective view of a boom in accordance with the invention.

The boom shown in FIG. 1 has a base 10 which is secured to a carrier. The carrier can be on a railroad, crawler based or rubber tyred chassis. One or more booms can be mounted on a single carrier, although this description will generally refer to a single boom machine.

The boom has an arm 12 connected to the base 10 through first and second mutually perpendicular pivot pins 14 and 16. A first hydraulic cylinder 18 serves to raise and lower the arm 12 about the axis of the pin 16, and a second cylinder 20 is used to slew the arm 12 about the vertical axis of the pivot pin 14.

The arm 12 shown in FIG. 1 is telescopic, and has an inner section 22 which can slide in and out of an outer section 24.

At the end of the arm 12 remote from the plate 10, a mounting 26 for a feed beam 28 is fitted. The feed beam 28 (which forms no part of this invention) supports a rock drill 30 and has guides 32 and 34 for a drill steel. The feed beam 28 slides longitudinally relative to the mounting 26, in a conventional manner.

At the outer end of the arm 12, another set of mutually perpendicular pivot pins are mounted comprising a third pin 36 and a fourth pin 38. Rotation of the feed beam 26 and its associated components about the axes of the pins 36 and 38 is accomplished by means of a third cylinder 40 and a fourth cylinder 42. The cylinder 40 is a lifting cylinder and controls movement about the axis of the pin 36, and the cylinder 42 is a slewing cylinder and controls movement about the axis of the pin 38.

Normally, the cylinders 18 and 40 will be connected in a common hydraulic circuit so that as the cylinder 18 extends, the cylinder 40 retracts and the mounting 26 executes parallel motion as the arm is raised and lowered. Similarly the cylinders 20 and 42 will be connected so that when the arm 12 is slewed the mounting 26 continues with parallel movement.

It will be seen that the feed beam 28 is offset to one side of the arm 12, and this allows the beam to be positioned close to a wall in a heading, without any obstruction from equipment such as the cylinders 40 and 42 mounted directly at the end of the arm.

Between the outer end of the arm 12 and the mounting 26, two mutually perpendicular rotation units 44 and 46 are positioned. The unit 44 is a roll-over unit and its operation allows the mounting 26 to perform a rotation around the axis of the unit 44 so that the feed beam 28 can take up a position offset to either side, or above or below the outer end of the arm 12. Similarly the rotation unit 46 allows the mounting 26 to perform rotation about the axis of the unit 46.

The rotation unit 44 may allow rotation through at least 360°. The rotation unit 46 only needs to allow 180° of rotation.

Figure 2:
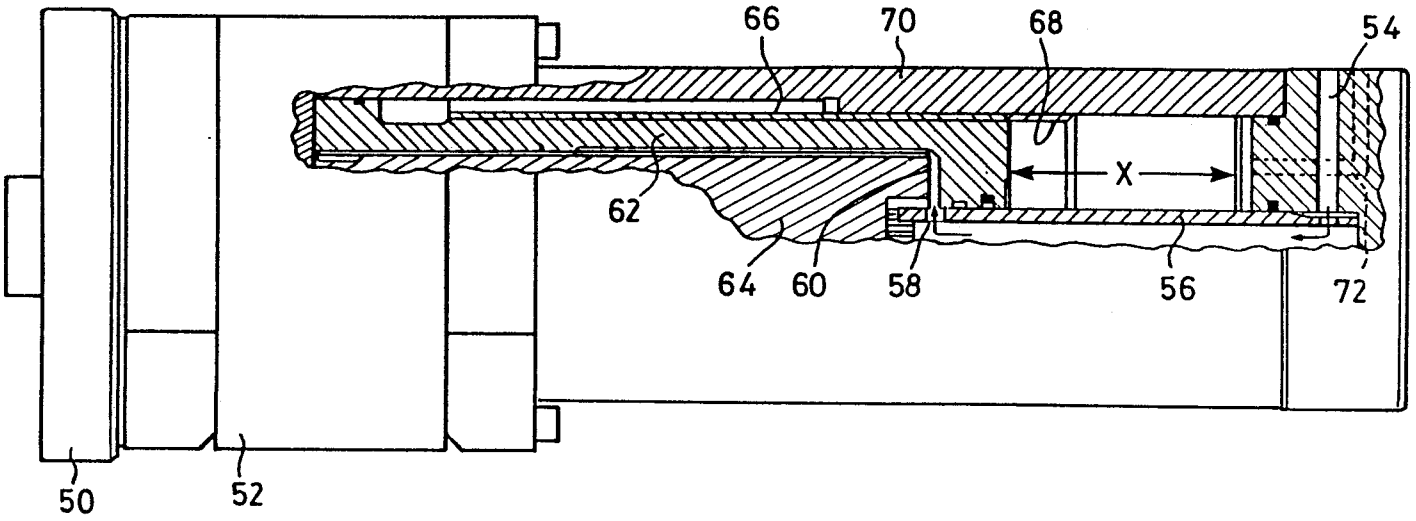
FIG. 2 is a cross-section through a rotation unit forming part of the boom of FIG. 1.

One type of rotation unit 46 which will permit 180° rotation about an axis at right angles to the length of the feed beam is shown in more detail in FIG. 2. The rotation unit has an end mounting plate 50 secured to the rotation unit 44, and thus to the boom 12 and a mounting ring 52 which is secured to the feed beam mounting 26. In use, relative rotation occurs between the plate 50 and the ring 52.

The rotation unit is actuated hydraulically. FIG. 2 shows one end position of the unit. To reach the other end position, hydraulic fluid is pumped in through an inlet 54, into the interior of an elongated tube 56, passes along the tube, through an aperture 58 in the tube wall and into a space 60 between a fixed central shaft 64 and a longitudinally movable nut 62. The nut 62 is splined to the shaft 64, and the hydraulic fluid penetrates through the splines between the nut 62 and the shaft 64 to the left hand end of the nut 62. The effect of this is that the pressure of the hydraulic fluid is applied to the nut 62, tending to force it to the right.

On the outer annular surface of the nut 62, rifled splines 66 (ie splines which follow a helical path) are formed. These splines 66 engage with corresponding rifled splines 68 on the inner face of a casing 70. As the nut 62 is driven to the right, relative rotation between the nut and the shaft 64 is prevented by the splines between them, but the engagement of the splines 66 with the corresponding splines 68 causes the outer casing 70 to rotate. The casing 70 carries with it the ring 52, to produce the relative rotation between the parts 50 and 52.

In order to reverse this rotation, the hydraulic fluid is applied, instead of through the passage 54, through a second passage 72 directly into the open chamber at the right hand end of the unit, so that the hydraulic fluid pressure is exerted against the end of the nut 62 driving it to the left and resulting in an opposite relative rotation between the parts 50 and 52.

The stroke of the nut 62, and thus the amount of angular rotation generated, will be determined by the distance X which is indicated in FIG. 2 and by the helix angle of the splining 66, 68.

In this way a smooth, stepless relative rotation between the parts 50 and 52 can take place. The rotation unit described also is compact and does not require any lever arms extending from the axis of rotation in order to generate the required rotation.

Although the plate 50 has been described as being attached to the boom 12, and the ring 52 to the feed beam, these attachment points could be reversed.

The rotation unit needs to be capable of holding the feed beam in the position to which it has been set, and of transmitting drilling loads. The rifle bar unit described achieves this through suitable dimensions of the components and as a result of the inherent characteristics arising from what is effectively a coarse pitch thread.

Alternatively, the rotation and holding functions could be separated, with a holding mechanism being provided to hold the components of the rotation unit in a desired position during drilling, and a rotation mechanism being provided for rotating the components whilst no drilling is taking place. The advantage of this is that the rotation mechanism can be more lightly dimensioned than would be possible if it had to transmit all the drilling loads.

The holding mechanism can be a mechanism with a thin metal sleeve shrunk onto a shaft. In its normal relaxed state, the sleeve tightly grips the shaft and holds it against rotation. However when hydraulic pressure is introduced between the sleeve and the shaft, the sleeve is expanded and releases the shaft. A suitable mechanism is sold by York Industries of York, Pa., USA under the name 'Bear-Loc'.

The rotation mechanism could take any suitable form to allow 180° of rotation. One possibility would be a system of intermeshing gears.

Figure 3:
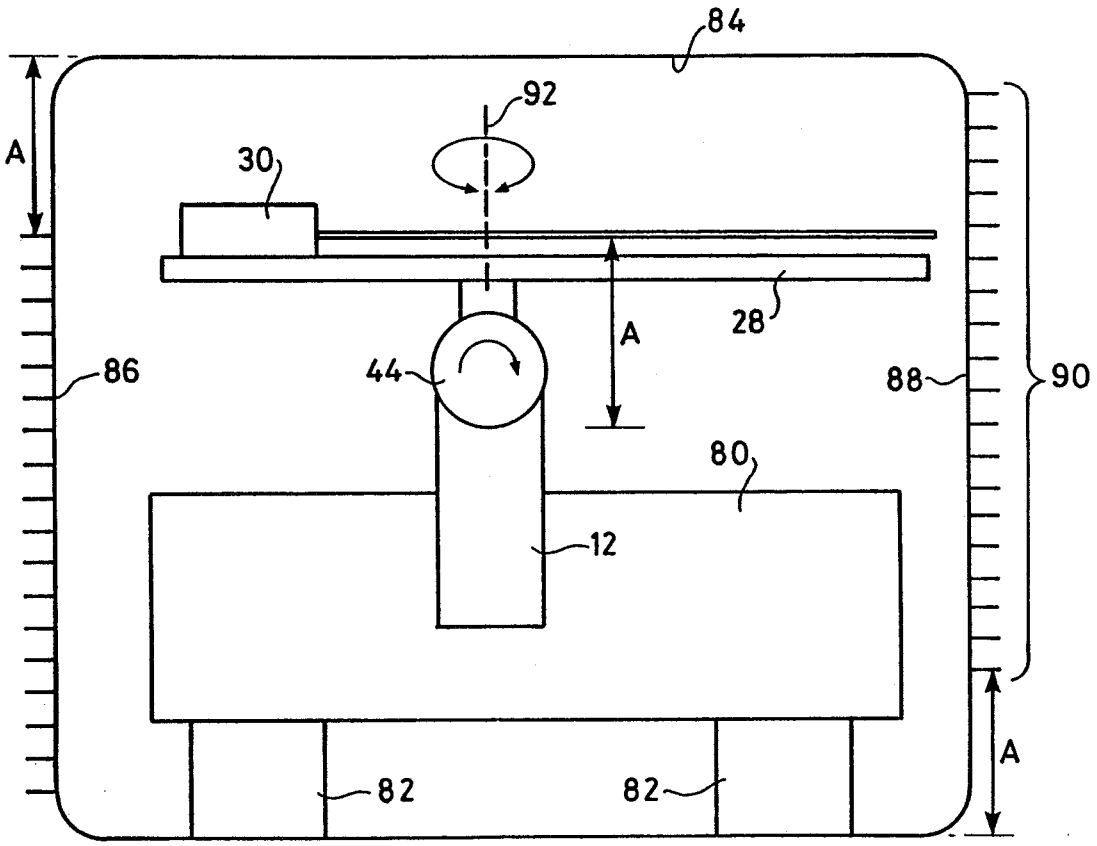
FIG. 3 shows a cross section through a heading illustrating the manner in which the heading walls can be drilled using the boom in accordance with the invention.

FIG. 3 schematically illustrates a machine 80 supported on crawler tracks 82 in a mine heading 84. The arm 12 is shown, as is the rotation unit 44, the feed beam 28 and the rock drill 30.

The feed beam 28 is shown in position for drilling into side walls 86 and 88 of the heading. In order to bring the beam 28 into the position shown in FIG. 3, from the position shown in FIG. 1, the rotation unit 44 is first operated until the beam 28 is above the axis of the unit 44. Then the rotation unit 46 is operated to swing the beam 28 so that it points towards one of the walls.

In this position, by raising and lowering the arm 12, parallel holes 90 can be drilled in the wall 88 of the heading. It has to be noted however that there is a distance marked A in FIG. 3 which is the distance that the feed beam 28 lies above the floor of the heading when the arm 12 is in its fully depressed position. Once the arm 12 is fully depressed, it is impossible to drill parallel holes any longer in the side wall 88, and there is therefore a region at the bottom of the wall 88 (where the distance A is again marked) where no holes can be drilled. It will of course be possible to drill angled holes by further rotating the unit 44, but such angled holes are not desirable.

The process can be repeated on the other side of the heading in the wall 86 by rotating the beam 28 through 180° about the axis of the unit 44. The tip of the drill steel is then adjacent to the opposite wall of the heading, and another series of holes can be drilled. However in this case the distance A will be the distance between the drill and the top of the unit 44 when this reaches its highest possible position in the heading. Again there will be a void area close to the top of the heading where holes cannot be drilled.

In order to avoid this problem the invention provides a further axis of rotation defined by the rotation unit 46. This axis is shown by dotted lines 92 in FIG. 3. Because it is now possible for the beam 28 to rotate through 180° about the axis 92, the drill can be used to drill in both side walls whilst it is positioned above the unit 44, and also whilst it is positioned below the unit 44. This allows holes to be drilled right up to the floor and the roof of both sides of the machine.

Although the invention is particularly directed towards a machine which has a single boom, because it is here where this problem of access to the corner of the heading is most noticeable, the use of the 180° rotation unit may also be advantageous on multi-boom drilling machines, not least because the embodiment shown with the rifle bar rotation unit offers significant space-saving advantages.

We claim:

1. A drilling boom, comprising:

an arm articulated at one end on a carrier which stands on a floor;

a mounting for a drill feed beam articulated at the opposite end of said arm and offset to one side of said arm, said arm and said mounting being arranged so that a drill on a mounted drill feed beam can drill sufficient holes in a rock face, including holes at floor level; and a roll-over unit between said mounting and said opposite end of said arm which allows said mounting to roll about a first axis which, in face drilling, will be parallel to the length of a drill on the mounted drill feed beam, said mounting including a rotation unit for rotating said drill feed beam through substantially 180° about a second axis offset from said first axis and perpendicular to the length of a drill on the mounted drill feed beam so that a drill on the mounted drill feed beam can operate in two mutually opposite directions.

2. A boom as claimed in claim 1, wherein the articulation between said arm, said carrier and said mounting is arranged so that said mounting executes parallel motion when said arm moves.

3. A boom as claimed in claim 1, wherein said rotation unit is a rifle bar rotation unit.

4. A boom as claimed in claim 1, wherein said rotation unit rotates said drill feed beam more than 180° about said second axis.

5. A boom as claimed in claim 1, wherein said roll-over unit has a rifle bar mechanism.

6. A boom as claimed in claim 1 and being hydraulically operated.

7. A boom as claimed in claim 1, wherein said arm is telescopic.

* * * * *